United States Patent [19]

Deiters

[11] Patent Number: 5,048,413

[45] Date of Patent: Sep. 17, 1991

[54] CAN CRUSHING APPARATUS

[76] Inventor: Fred J. Deiters, 56 Greenridge Ct., Lake Oswego, Oreg. 97035

[21] Appl. No.: 501,604

[22] Filed: Mar. 29, 1990

[51] Int. Cl.[5] ..... B30B 9/32

[52] U.S. Cl. ..... 100/226; 100/131; 100/902

[58] Field of Search ..... 100/226, 902, 53, 228, 100/255, 100, 131

[56] References Cited

U.S. PATENT DOCUMENTS

| | | | |
|---|---|---|---|
| 2,616,477 | 11/1952 | Scheer et al. | 100/131 |
| 2,737,995 | 3/1956 | Jennings | 100/215 |
| 3,374,730 | 3/1968 | Cain | 100/902 |
| 4,240,341 | 12/1980 | Whipple et al. | 100/215 |
| 4,570,536 | 2/1986 | Dodd | 100/902 |
| 4,656,937 | 4/1987 | Turner, Jr. | 100/100 |
| 4,700,623 | 10/1987 | Durbin et al. | 100/100 |

FOREIGN PATENT DOCUMENTS

| | | | |
|---|---|---|---|
| 2254828 | 5/1974 | Fed. Rep. of Germany | 100/226 |
| 2903531 | 8/1980 | Fed. Rep. of Germany | 100/229 A |

*Primary Examiner*—William A. Cuchlinski, Jr.
*Assistant Examiner*—G. Bradley Bennett
*Attorney, Agent, or Firm*—Eugene M. Eckelman

[57] ABSTRACT

A platform is supported on uprights on a base and extends over the top of an open top waste receptacle arranged to be supported on the base. A can crushing compartment is supported on the platform and has a powered plunger arranged to crush cans in the compartment to a reduced size. The compartment in which the cans are crushed has a bottom opening which is of restricted size whereby to maintain cans in the compartment prior to crushing but which allows cans to fall by gravity into the waste receptacle after being crushed. Sealing structure is provided between the platform and the waste receptacle and also between a cover on the crushing compartment. Venting inlets and outlets are provided on the platform that admit fresh air and that carry away fumes from the waste receptacle.

3 Claims, 2 Drawing Sheets

CAN CRUSHING APPARATUS

BACKGROUND OF THE INVENTION

This invention relates to a new and novel can crushing apparatus.

Empty cans pose a considerable problem in that in their handling and disposal, they consume a large space. Thus, it is preferred that the cans be crushed or otherwise reduced in size in order to make their handling and disposal easier and less costly. Another problem that empty cans pose is that frequently they are filled with hazardous material whereby persons handling them subject themselves to dangers of the material. All in all, metal cans and particularly the larger type, such as gallon cans, are difficult to dispose of. Without being crushed they are costly to handle and be disposed of.

SUMMARY OF THE INVENTION

According to the present invention and forming a primary objective thereof, a can crushing apparatus is provided that compacts cans in a novel way to reduce the volume of waste metal in their disposal.

Another object of the invention is to provide an apparatus of the type described that requires minimum handling for the operator.

Yet another object of the invention is to provide a can crushing apparatus that provides seal means associated with the cans being crushed and the waste receptacle into which the crushed cans are discharged, thus reducing to a minimum the exposure of the operator to hazardous material or fumes.

In carrying out these objectives, a can crushing apparatus is provided that utilizes upright support means on a base that supports a platform dimensioned and arranged to extend over the top of an open top waste receptacle. Can crushing means on the platform have a compartment arranged to receive cans to be crushed and also have powered plunger means arranged to crush the cans in such compartment to a reduced size. An opening is provided in the platform through which crushed cans fall from the crushing compartment into the waste receptacle. The opening is of a selected size which prevents the cans from falling therethrough prior to crushing but which allow the cans when reduced to fall by gravity into the waste receptacle. Seal means are provided for a door on the can receiving compartment and also on the underside of the platform which provide a sealed engagement with the top edge of a waste receptacle, thus protecting the operator from fumes of hazardous material.

The invention will be better understood and additional objects and advantages will become apparent from the following description taken in connection with the accompanying drawings.

DETAILED DESCRIPTION OF A PREFERRED EMBODIMENT

Figure 1:
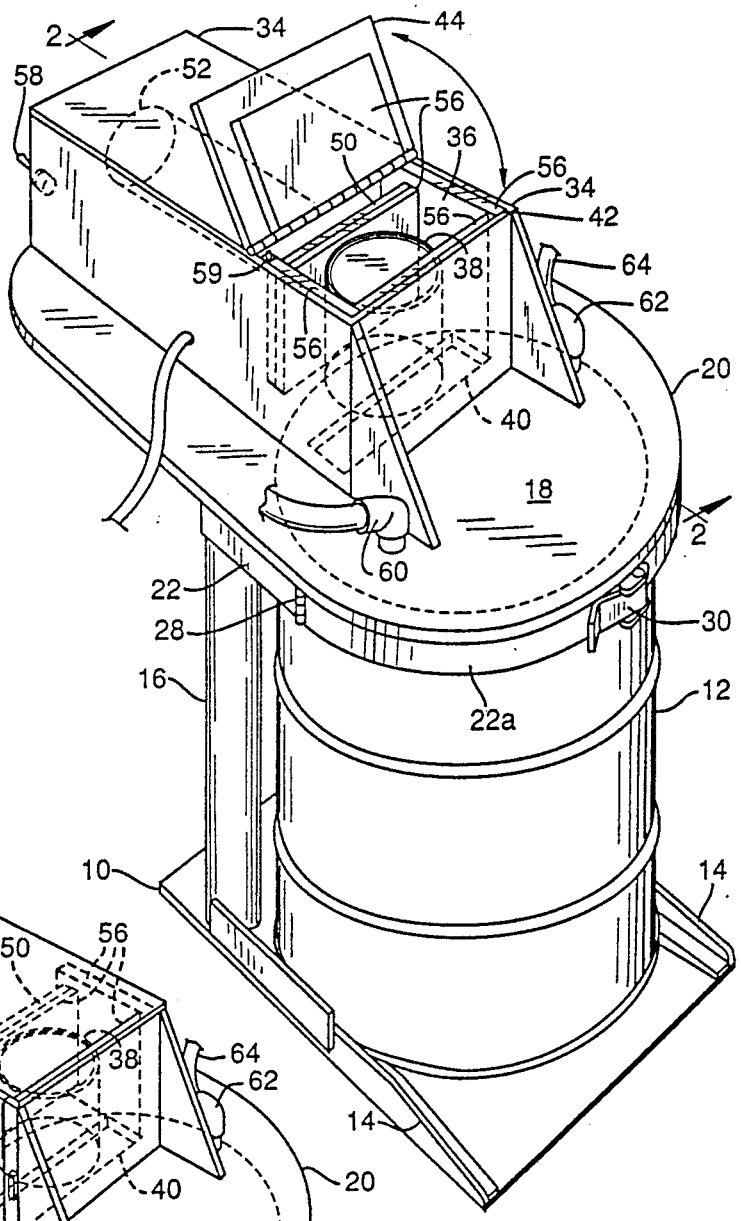
FIG. 1 is a perspective view of the can crushing apparatus of the invention, the apparatus being shown in a step thereof wherein a can has just been loaded for crushing, this view showing a first form of can loading door.

With particular reference to the drawings, the can crushing apparatus of the invention comprises a base 10, such as a flat plate, arranged to support a waste receptacle 12 removably thereon. Preferably, the base 10 has side guide walls 14 at the bottom between which the waste receptacle can be slid into place from the front.

Two or more uprights or standards 16 are integrated with the base and support a horizontal platform or wall 18 having a rounded front edge 20 configured similar to the round shape of a waste receptacle such as a 55-gallon drum.

The underside of the platform 18 has a depending flange 22 with a circular inner defining wall surface 24. This inner wall surface, and the bottom surface of the platform 18, are covered with a resilient sealing layer 26, the circular wall surface 24 being of selected size such that the sealing layer will engage a top portion of the waste receptacle in peripheral sealing engagement. The forward half of the depending flange 22 comprises a pair of arms **22*a* pivotally connected at one of their ends at the sides to the rear portion of the flange by hinges 28 and carrying latch elements 30 at the front for releasable secured connection encircling the waste receptacle top. Upon release of the latch elements 30, the arms 22*a* can be swung outwardly for allowing the waste receptacle to be moved in or out. With the waste receptacle in place, the arms 22*a* can be cinched around the upper portion of the waste receptacle and locked together at the front. With the rear portion of the waste receptacle fitting in the rear portion of the seal 26**, a complete seal around the top portion of the receptacle is accomplished.

Platform 18 supports a crusher housing 34 having a front compartment 36 arranged to receive empty cans 38 in upright relation. This compartment communicates with the waste receptacle by means of a floor opening 40 in the platform. Opening 40 is of a lateral dimension greater than a can when in either an uncrushed or crushed condition and is of a dimension from front to rear which is less than an uncrushed can but greater than that of a crushed can. Thus, when an empty can is loaded into the compartment 36, it will still be supported by the floor of the compartment 36. However when crushed, the can will be sufficiently reduced in size to drop by gravity along the front surface of the compartment and through the opening 40 into the waste receptacle.

Figure 4:
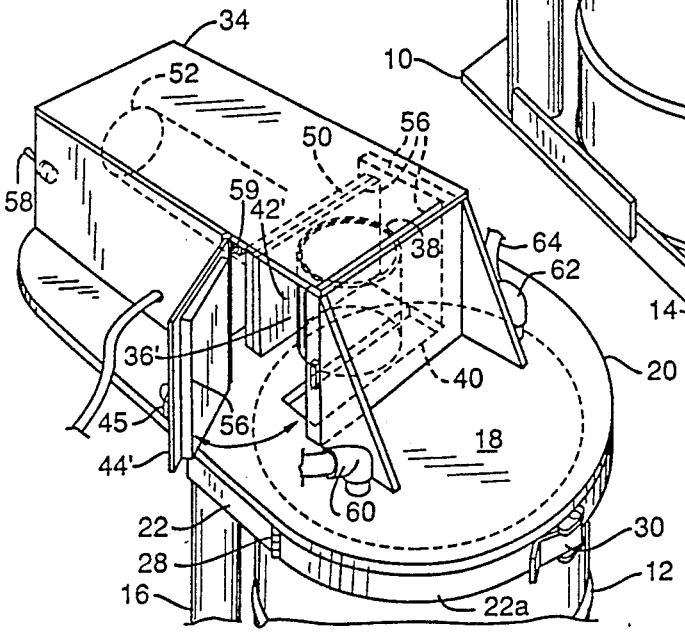
FIG. 4 is a view similar to FIG. 1 but showing a second form of can loading door.
Figure 2:
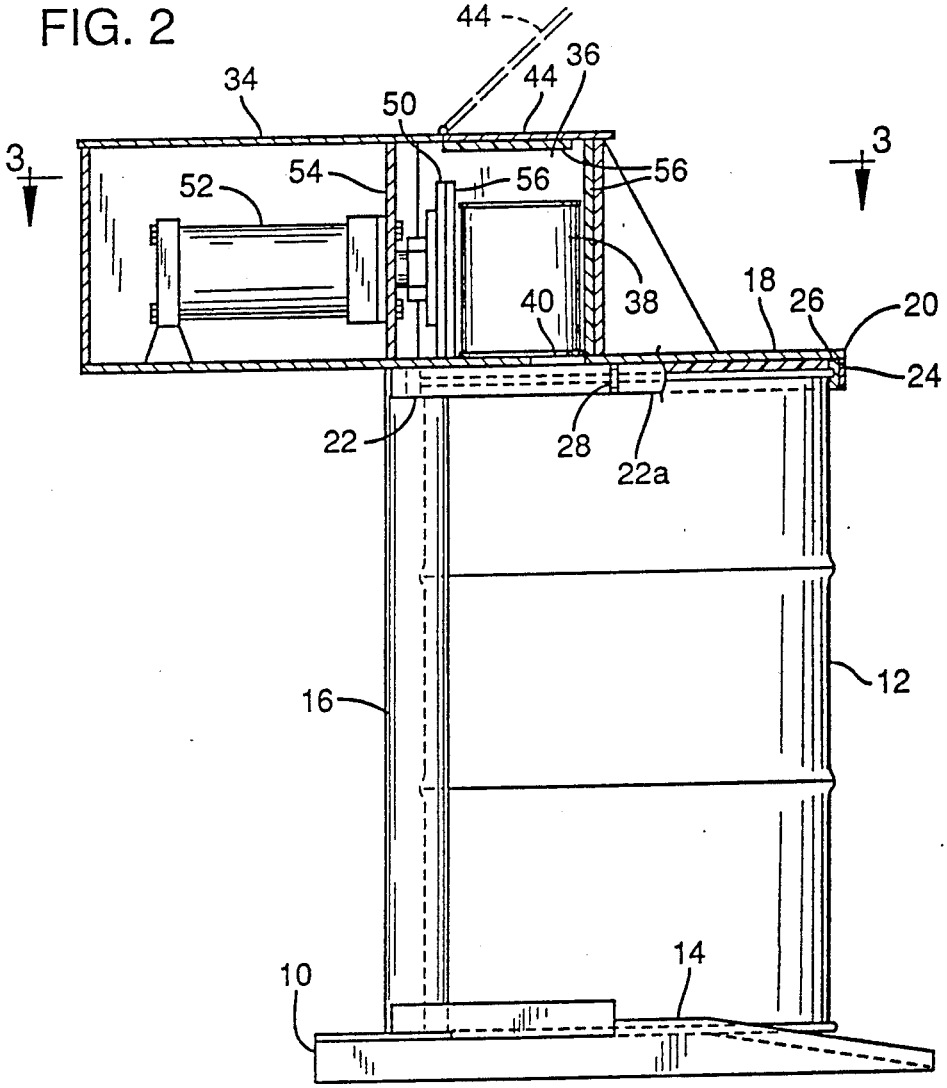
FIG. 2 is a longitudinal vertical sectional view taken on the line 2—2 of FIG. 1.
Figure 3:
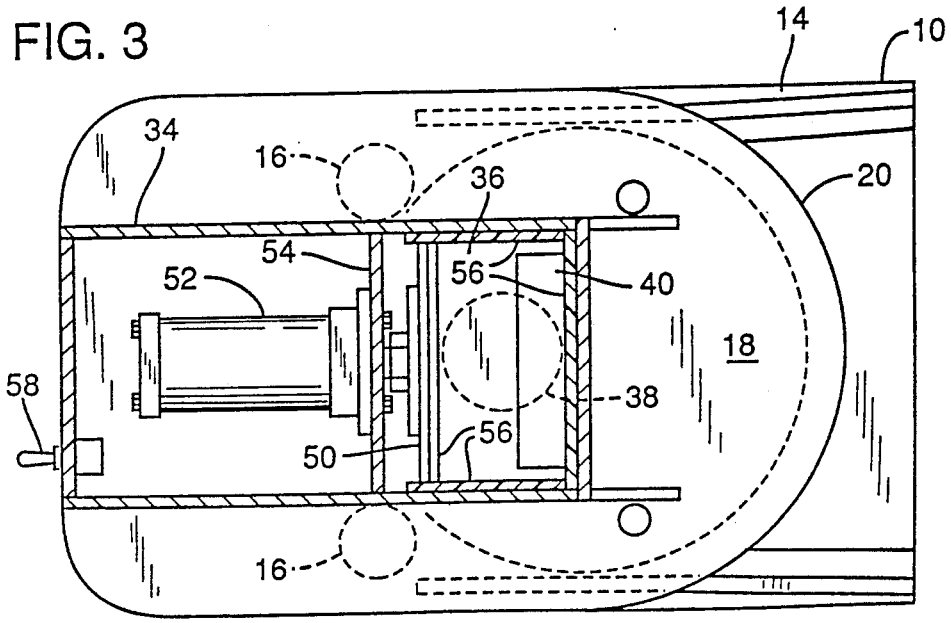
FIG. 3 is a horizontal sectional view taken on the line 3—3 of FIG. 2.

In the FIG. 1 embodiment, the compartment 36 has a top opening 42 through which the cans are loaded. This opening has a hinged door or cover 44 with air sealing engagement on the compartment when closed. In the embodiment of FIG. 4, the opening 42' into the crushing compartment 36' is on one side rather than the top. The door 44' in this embodiment has latch means 45 for holding it shut.

Can crushing means comprises a ram head 50 operated by a ram 52 mounted in the rear portion of housing 34 and suitably anchored to the housing, including to an intermediate wall 54. Ram 52 has automatic return of its head upon completion of a crushing movement. Such return may be accomplished by suitable conventional circuitry or spring return.

The front wall of compartment 36 serves as an abutment wall for the ram, this wall being reinforced by end gussets 48. Preferably the front wall, the side walls, and the face of the ram head have a covering or layer 56 of conventional non-sparking material such as an ultra high molecular polyurethane.

Platform 18, in the area over the waste receptacle, has a one-way air inlet 60 and an air outlet 62 connected to a discharge conduit 64 arranged to carry fumes away from the crushing area.

In the operation of the present apparatus, the arms 22*a* are opened and a waste receptacle 12 pushed into place. When moving the waste receptacle into place it is pushed rearwardly an amount to engage the rear semicircular seal 26 of the flange 22. The arms 22*a* are then closed and latched. The door 44 or 44' of the crushing compartment 36 is opened and a can inserted, preferably in upright relation. The door is then closed and the ram activated, as by a control switch 58. The ram head crushes the can to a flat condition whereby when the ram head starts to withdraw, the can will drop by gravity through the opening 40 into the waste receptacle. Any air displaced during crushing is forced out through outlet 62. The cans can be inserted in other positions than upright if desired; however, cans usually have a residue therein and by inserting them right side up, the residue will be deposited in the receptacle without spilling. Preferably, the switch 58 is located on the rear wall of the housing 34 for safety reasons and also, the drive circuit for the ram, not shown, has a cut-off switch 59 adjacent the door hinge whereby to insure that the door is closed before the ram will move.

By means of the present structure, a minimum of handling is provided and thus a minimum of exposure to the operator. Such is important when the cans may have contained toxic, caustic, flammable or other dangerous material. Compartment 36 is sealed during the crushing operation and the waste receptacle is also sealed with the platform 18, thus here again the operator is exposed to minimum fumes or other toxic material. The cans being reduced to a flat condition take up minimum space in waste handling and disposal.

It is to be understood that the form of our invention herein shown and described is to be taken as a preferred example of the same and that various changes in the shape, size and arrangement of parts may be resorted to without departing from the spirit of our invention, or the scope of the subjoined claims.

Having thus described our invention, we claim:

1. A can crushing apparatus for use with an open top waste receptacle comprising:

a flat supporting base having front, rear and side portions;

upright guide walls on the sides of said base arranged to guide a waste receptacle therebetween onto the base when the receptacle is moved in from the front of said base;

a horizontal platform supported on said upright standard means having upper and lower surfaces, said platform having a front portion projecting from said standard means to closely overlie an open top waste receptacle supported on the base;

a depending flange on the flower surface of said platform having an inner surface contour similar to the outer contour of a top portion of a waste receptacle, said flange having a rear abutment arranged for engagement by a waste receptacle and also having a front releasable connection that allows movement of the waste receptacle into engagement with said rear abutment and removal of the waste receptacle, and seal means at the lower surface of said platform having sealing engagement with an upper portion of the waste receptacle when the latter is seated on the base whereby to confine toxic material within the waste receptacle, can crushing means on said platform having a compartment arranged to receive cans to be crushed and also having powered plunger means arranged to crush said cans to a reduced size;

and an opening in said platform through which crushed cans can fall into the waste receptacle, said opening being of a size to restrict cans from falling therethrough before crushing but to allow cans to fall therethrough into the waste receptacle after they are reduced in size by crushing.

2. The can crushing apparatus of claim 1 wherein said compartment comprises a closed area with a can receiving door to also confine toxic materials within the waste receptacle, said seal means comprising a sealing strip having a portion that depends from the lower surface of said platform for engaging the top edge of the waste receptacle and a portion extending down along the inner surface of said flange for engaging a side surface portion of the waste receptacle.

3. The can crushing apparatus of claim 1 including forced air inlet and outlet means in said platform opening through the lower surface of said platform for communication with the waste receptacle to carry away gases from within the receptacle.

* * * * *